US007675235B2

(12) United States Patent
Shiina et al.

(10) Patent No.: US 7,675,235 B2
(45) Date of Patent: Mar. 9, 2010

(54) PLASMA DISPLAY PANEL

(75) Inventors: Sumito Shiina, Kanagawa (JP); Yuichi Ishida, Kanagawa (JP); Tadahiro Kono, Tokyo (JP); Hidehiro Kawaguchi, Kanagawa (JP)

(73) Assignee: Sony Corporation, Tokyo (JP)

( * ) Notice: Subject to any disclaimer, the term of this patent is extended or adjusted under 35 U.S.C. 154(b) by 360 days.

(21) Appl. No.: 11/697,483

(22) Filed: Apr. 6, 2007

(65) Prior Publication Data

US 2007/0241685 A1 Oct. 18, 2007

(30) Foreign Application Priority Data

Apr. 12, 2006 (JP) ..... 2006-110039

(51) Int. Cl.
*H01J 17/49* (2006.01)

(52) U.S. Cl. ..... 313/586; 313/582

(58) Field of Classification Search ..... 313/582–586
See application file for complete search history.

(56) References Cited

FOREIGN PATENT DOCUMENTS

| | | | |
|---|---|---|---|
| JP | 2002-075220 | | 3/2002 |
| JP | 2003-197110 | | 7/2003 |
| JP | 2004063292 A | * | 2/2004 |
| JP | 2006-324254 | | 11/2006 |

* cited by examiner

*Primary Examiner*—Vip Patel
(74) *Attorney, Agent, or Firm*—K&L Gates LLP

(57) ABSTRACT

A plasma display panel is provided. The plasma display panel includes a front panel including a front glass substrate, a plurality of pairs of discharge-maintaining electrodes disposed over the front glass substrate, and a first dielectric layer disposed in covering relation to the pairs of discharge-maintaining electrodes, and a rear panel disposed in confronting relation to the front panel with discharge spaces interposed therebetween, the front panel including a second dielectric layer disposed between the front glass substrate and the pairs of discharge-maintaining electrodes, the second dielectric layer including a cluster of fine particles of silica.

5 Claims, 3 Drawing Sheets

PLASMA DISPLAY PANEL

CROSS REFERENCES TO RELATED APPLICATIONS

The present application claims priority to Japanese Patent Application JP 2006-110039 filed in the Japan Patent Office on Apr. 12, 2006, the entire contents of which being incorporated herein by reference.

BACKGROUND

The present application relates to a plasma display panel for use in a plasma display apparatus.

Plasma display panels (hereinafter referred to as "PDP") display an image by generating an ultraviolet radiation from a plasma discharge of a rare gas such as Ne, Xe, Ar, or the like, and exciting a phosphor with the ultraviolet radiation to emit visible light.

The PDPs are classified into AC-driven PDPs and DC-driven PDPs. The AC-driven PDPs are better than the DC-driven PDPs as to luminance, emission efficiency, and longevity, and are main-stream PDPs.

FIG. 5 of the accompanying drawings is a fragmentary sectional perspective view of an AC-driven PDP in the past. In FIG. 5, the AC-driven PDP in the past has a front panel 1 and a rear panel 2 which are disposed in facing relation to each other.

The front panel 1 has a front glass substrate 11 which is transparent and insulative and a plurality of pairs of parallel discharge-maintaining electrodes 12*a*, 12*b* disposed on the lower surface of the front glass substrate 11 and spaced at a given pitch. The discharge-maintaining electrodes 12*a*, 12*b* include transparent electrodes. The front panel 1 also includes a dielectric layer 14 disposed on the lower surface of the front glass substrate 11 in covering relation to the pairs of discharge-maintaining electrodes 12*a*, 12*b*, and a protective layer 15 disposed on the lower surface of the dielectric layer 14. Bus electrodes 13*a*, 13*b* are disposed on the respective lower surfaces of the discharge-maintaining electrodes 12*a*, 12*b* for reducing the wiring resistance thereof.

The bus electrodes 13*a*, 13*b* on the lower surfaces of the discharge-maintaining electrodes 12*a*, 12*b* extend parallel to the discharge-maintaining electrodes 12*a*, 12*b* and are narrower than the discharge-maintaining electrodes 12*a*, 12*b*.

The dielectric layer 14 on the lower side of the discharge-maintaining electrodes 12*a*, 12*b* has an inherent current limiting function which gives the AC-driven PDP a longer service life than the DC-driven PDPs. The dielectric layer 14 is generally formed by printing and baking a layer of glass having a low melting point.

The protective layer 15 serves to prevent the dielectric layer 14 from being sputtered by the plasma discharge. The protective layer 15 needs to be made of a material which is highly resistant to sputtering. Specifically, the protective layer 15 is often made of magnesium oxide (MgO). Since MgO has a large secondary electron emission coefficient, the protective layer 15 is also effective to lower the discharge starting voltage.

The rear panel 2 has a rear glass substrate 21 which is transparent and insulative and a plurality of address electrodes 22 for writing image data, disposed on the upper surface of the rear glass substrate 21 and extending perpendicularly to the pairs of discharge-maintaining electrodes 12*a*, 12*b* of the front panel 1. The rear panel 2 also includes a dielectric layer 23 disposed on the upper surface of the rear glass substrate 21 in covering relation to the address electrodes 22, a plurality of partitions 24 extending parallel to the address electrodes 22 and disposed on the dielectric layer 23 at respective positions substantially intermediate between adjacent ones of the address electrodes 22, and a plurality of phosphor layers 25 disposed in regions between adjacent ones of the partitions 24 and extending up to upper ends of the partitions 24.

The phosphor layers 25 include a plurality of sets of adjacent phosphor layers 25R, 25G, 25B coated with materials for emitting red (R) light, green (G) light, and blue (B) light, respectively. Each set of phosphor layers 25R, 25G, 25B provides pixels.

Between the front and rear panels 1, 2 which confront each other, there are provided striped discharge spaces 4 each surrounded by two adjacent partitions 24, the protective layer 15 on the lower surface of the front glass substrate 11, and the phosphor layer 25 between the partitions 24 above the rear glass substrate 21.

The discharge spaces 4 are filled with a rare gas such as Ne, Xe, Ar, or the like under the pressure of about 66.5 kPa. When an AC voltage having a frequency ranging from several tens to several hundreds kHz is applied through the bus electrodes 13*a*, 13*b* between the discharge-maintaining electrodes 12*a*, 12*b*, a plasma discharge occurs in the rare gas, exciting rare gas molecules. When the excited rare gas molecules return to the ground state, they generate an ultraviolet radiation which excites the phosphor layers 25 to emit light.

The phosphor layers 25R, 25G, 25B emit R, G, B lights, respectively. The address electrodes 22 are selectively energized to select desired pixels to emit light in desired colors for thereby displaying a color image on the plasma display panel.

When the AC voltage applied through the bus electrodes 13*a*, 13*b* between the discharge-maintaining electrodes 12*a*, 12*b*, as shown in FIG. 6 of the accompanying drawings, a displacement current flows to charge an electrostatic capacitance 40 having a dielectric body provided by the front glass substrate 11 between the discharge-maintaining electrodes 12*a*, 12*b* and an electrostatic capacitance 41 having a dielectric body provided by the dielectric layer 14 between the discharge-maintaining electrodes 12*a*, 12*b*.

The displacement current is a reactive current which does not directly contribute to the display of the image, and causes resistive components of the discharge-maintaining electrodes 12*a*, 12*b* and a control circuit therefor to produce a loss, tending to produce a reactive power.

As the reactive power increases, not only the power consumption of the AC-driven PDP for displaying images, but also the power consumption of IC circuits for energizing the AC-driven PDP increase. As a result, the IC circuits generate heat and become unstable in operation.

In order for the AC-driven PDP to have a higher resolution, it is necessary to employ a greater number of pairs of discharge-maintaining electrodes 12*a*, 12*b*. As the number of pairs of discharge-maintaining electrodes 12*a*, 12*b* increases, the electrostatic capacitance per panel increases, and since the front glass substrate 11 is of a relatively large relative permittivity of about 8, the electrostatic capacitance 40 becomes relatively large, resulting in an increase in the reactive power. Inasmuch as it is important for the AC-driven PDPs to have lower power requirements, there have been demands for reduced electrostatic capacitances 40, 41 for reduced reactive power.

Japanese patent laid-open No. 2003-197110 discloses a PDP including a dielectric layer made of a glass material containing $B_2O_3$ and $SiO_2$ as chief components, the dielectric layer being disposed between a front glass substrate and a plurality of pairs of discharge-maintaining electrodes for thereby reducing the electrostatic capacitances.

However, the disclosed PDP structure fails to sufficiently reduce the electrostatic capacitances.

SUMMARY

In an embodiment, a plasma display panel is provided which is constructed to reduce electrostatic capacitances between paired discharge-maintaining electrodes for reduced power consumption, i.e., reduced reactive power.

According to an embodiment, a plasma display panel has a front panel and a rear panel disposed in confronting relation to the front panel with discharge spaces interposed therebetween. The front panel includes a front glass substrate, a plurality of pairs of discharge-maintaining electrodes disposed over the front glass substrate, a first dielectric layer disposed in covering relation to the pairs of discharge-maintaining electrodes, and a second dielectric layer disposed between the front glass substrate and the pairs of discharge-maintaining electrodes, the second dielectric layer including a cluster of fine particles of silica.

According to another embodiment, a plasma display panel has a front panel and a rear panel disposed in confronting relation to the front panel with discharge spaces interposed therebetween. The front panel includes a front glass substrate, a plurality of pairs of discharge-maintaining electrodes disposed over the front glass substrate, and a dielectric layer disposed between the front glass substrate and the pairs of discharge-maintaining electrodes and in covering relation to the pairs of discharge-maintaining electrodes, the dielectric layer including a cluster of fine particles of silica.

As described above, the dielectric layer including a cluster of fine particles of silica is disposed between the front glass substrate and the pairs of discharge-maintaining electrodes. The dielectric layer has pores between the fine particles of silica. The dielectric layer has pores between adjacent fines particles of silica, and has a relative permittivity smaller than the relative permittivity, e.g., 4, of silica ($SiO_2$). Therefore, the electrostatic capacitance between the discharge-maintaining electrodes is reduced to the reduce power consumption, i.e., reactive power, of the plasma display panel.

Additional features and advantages are described herein, and will be apparent from, the following Detailed Description and the figures.

DETAILED DESCRIPTION

Figure 5:
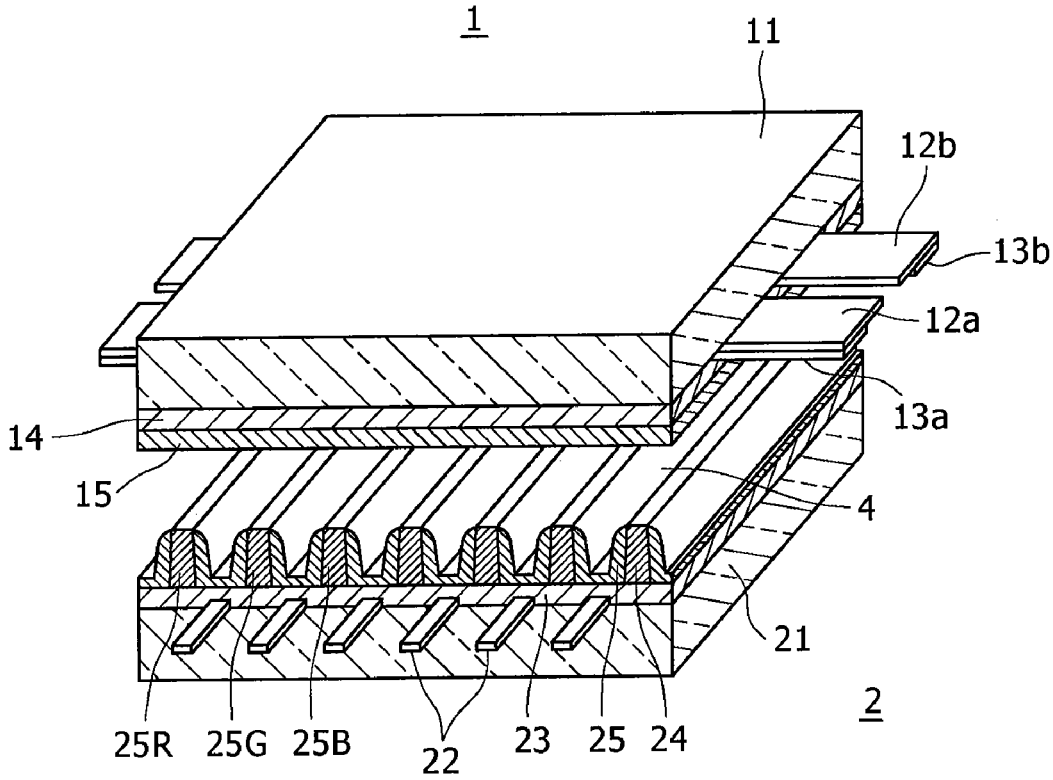
FIG. 5 a fragmentary sectional perspective view of a plasma display panel in the past.
Figure 6:
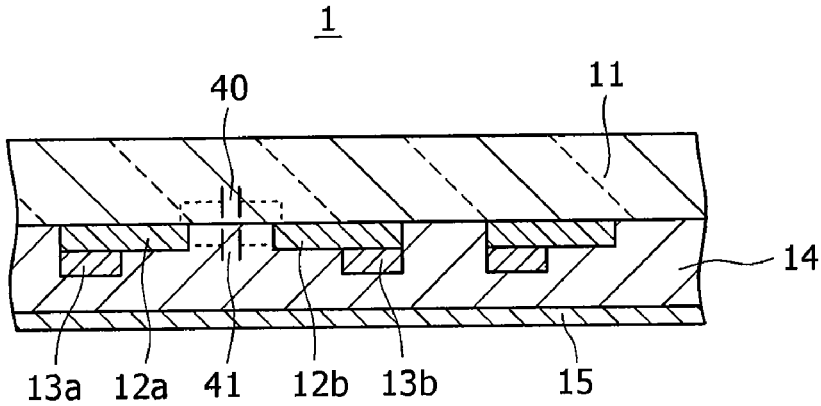
FIG. 6 is a fragmentary cross-sectional view of a front panel of the plasma display panel in the past shown in FIG. 5.

A plasma display panel according to an embodiment will be described below with reference to FIGS. 1 through 3. Those parts of plasma display panel shown in FIGS. 1 through 3 which are identical to those shown in FIGS. 5 and 6 are denoted by identical reference characters.

Figure 1:
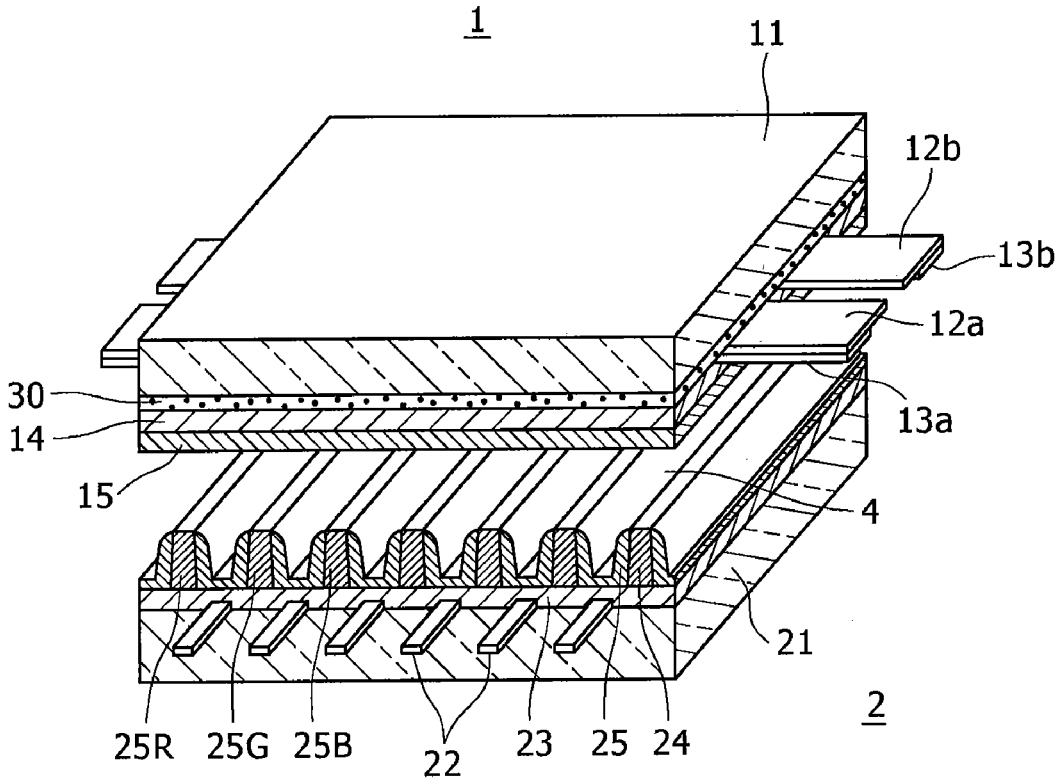
FIG. 1 is a fragmentary sectional perspective view of a plasma display panel according to an embodiment.

FIG. 1 is a fragmentary sectional perspective view of an AC-driven PDP according to an embodiment. As shown in FIG. 1, the AC-driven PDP has a front panel 1 and a rear panel 2 which are disposed in facing relation to each other.

Figure 2:
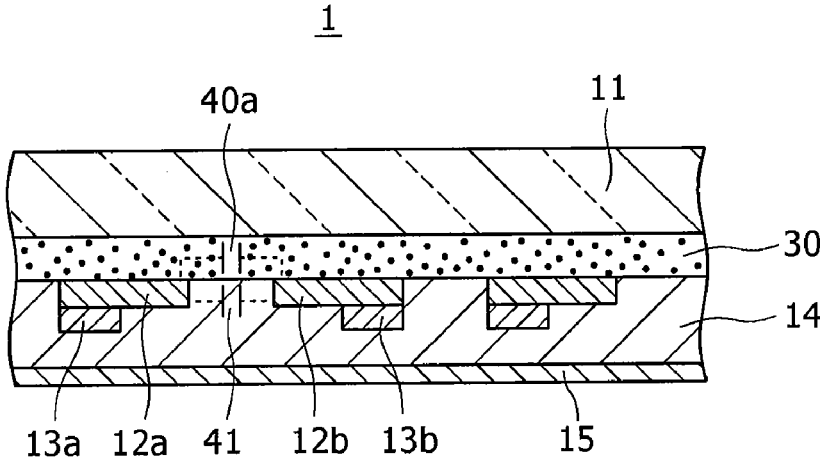
FIG. 2 is a fragmentary cross-sectional view of a front panel of the plasma display panel shown in FIG. 1.

As shown in FIGS. 1 and 2, the front panel 1 includes a dielectric layer 30 including a cluster of fine particles of silica. The dielectric layer 30 is disposed on the lower surface of a front glass substrate 11 which is made of high-strain-point glass or soda glass, for example, and which is transparent and insulative.

The dielectric layer 30 is formed by coating the lower surface of the front glass substrate 11 with a colloidal silica paste in which fine particles of silica are evenly dispersed, by a die coating process, a printing process, a green sheet laminating process, or the like.

The colloidal silica paste includes at least several % of fine particles of silica having diameters in the range from 1 to 100 nm, and a solvent containing a suitable binder and water as chief components.

The layer of the colloidal silica paste has a thickness of about 200 μm immediately after it is applied to the lower surface of the front glass substrate 11. After the colloidal silica paste is sufficiently dried at room temperature and then baked, the layer of the colloidal silica paste has a thickness of about 20 μm.

The diameters of the fine particles of silica are in the range from 1 to 100 nm for the following reasons: If the diameters are smaller than 1 nm, then the surface energy of the fine particles of silica contributes so much that the fine particles of silica tend to become too unstable to keep themselves in a uniform colloidal state. If the diameters are greater than 100 μm, then the fine particles of silica are liable to diffuse visible light, resulting in a reduction in the light transmission.

Figure 3:
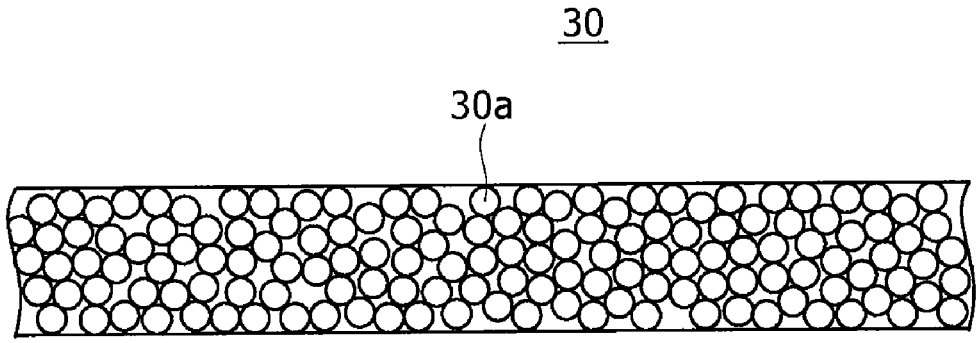
FIG. 3 is an enlarged fragmentary cross-sectional view of a dielectric layer of the front panel shown in FIG. 1.

The dielectric layer 30 in the form of a layer including a cluster of fine particles of silica has a relative permittivity in the range of 1.0 to 4.0 lower than the relative permittivity of silica and higher than the relative permittivity of pores because pores are present between fine particles 30*a* of silica, as shown in FIG. 3.

If it is assumed that a cluster of fine particles having the same diameter is most closely packed, then the relative permittivity thereof is calculated below. The relative permittivity ∈(f) of a porous body having a porosity f is expressed according to the Maxwell-Garnett model as follows:

$$\varepsilon(f) = \varepsilon_B + 3f\varepsilon_B \frac{\varepsilon_P - \varepsilon_B}{\varepsilon_B + 2f\varepsilon_B - f(\varepsilon_P - \varepsilon_B)}$$

where $\in_B$ represents the relative permittivity of the matrix material and $\in_P$ the relative permittivity of the pores. If a group of particles having the same diameter is most closely packed, the porosity thereof is f=0.26 (the packing ratio is 0.74).

If the matrix material is silica ($\in_B \approx 4.0$) and the pores are a discharging gas ($\in_P \approx 1.0$), then the relative permittivity is calculated as ∈=3.0 by substituting these values in the above equation. In other words, a cluster of fine particles of silica which have the same diameter and which are mostly closely packed has a relative permittivity of 3.0. However, since an actual cluster of fine particles of silica has a large porosity because the particles have different diameters and are positioned irregularly, the relative permittivity thereof is expected to be smaller than 3.0. If the porosity is too large, then the mechanical strength and insulating capability are lowered. Therefore, the preferable relative permittivity of the dielectric layer 30 should be in the range from 1.3 to 3.0.

A cluster of fine particles may contain groups of fine particles having at least two larger and smaller diameters. If the particles having the larger diameters are most closely packed, then the particles having the smaller diameters may enter the pores, and the porosity may be reduced. In this case, the relative permittivity of the cluster of fine particles may be 3.0 or greater.

The dielectric layer 30 according to the present embodiment may be of a single-layer structure or a multi-layer structure. The dielectric layer 30 has a thickness in the range from 1 to 100 μm or preferably in the range from 10 to 40 μm. If the thickness of the dielectric layer 30 is too small, the ability of the dielectric layer 30 to reduce the electrostatic capacitances is lowered. If the thickness of the dielectric layer 30 is too large, then the cost of the dielectric layer 30 is increased.

As shown in FIGS. 1 and 2, the front panel 1 also includes a plurality of pairs of parallel discharge-maintaining electrodes 12*a*, 12*b* disposed on the lower surface of the dielectric layer 30 and spaced at a given pitch. The discharge-maintaining electrodes 12*a*, 12*b* include transparent electrodes.

The discharge-maintaining electrodes 12*a*, 12*b* are made of a transparent electrically conductive material such as ITO (indium tin oxide), $SnO_2$, $ZnO_2$:Al, $ZnO_2$, or the like.

The thickness of each of the discharge-maintaining electrodes 12*a*, 12*b* is not limited to any particular value, but is preferably in the range from about 100 to 400 μm. The distance between the discharge-maintaining electrodes 12*a*, 12*b* in each pair is not limited to any particular value, but is preferably in the range from about 5 to 150 μm.

Bus electrodes 13*a*, 13*b* are disposed on respective lower surfaces of the discharge-maintaining electrodes 12*a*, 12*b* for reducing the wiring resistance thereof. The bus electrodes 13*a*, 13*b* on the lower surfaces of the discharge-maintaining electrodes 12*a*, 12*b* extend parallel to the discharge-maintaining electrodes 12*a*, 12*b* and are narrower than the discharge-maintaining electrodes 12*a*, 12*b*.

The bus electrodes 13*a*, 13*b* are typically in the form of a single-layer metal film of Ag, Au, Al, Ni, Cu, Mo, Cr, or the like or a laminated-layer metal film of Cr/Cu/Cr or the like. The width of each of the bus electrodes 13*a*, 13*b* is in the range from about 30 to 200 μm, for example.

The front panel 1 also includes a dielectric layer 14 disposed on the lower surface of the dielectric layer 30 in covering relation to the pairs of discharge-maintaining electrodes 12*a*, 12*b*. The dielectric layer 14 is formed by baking a glass paste film.

The dielectric layer 14 has a memory function to store wall charges generated in address periods to maintain a discharged state, a function to limit an excessive discharge current, and a function to protect the discharge-maintaining electrodes 12*a*, 12*b*.

A protective layer 15 is disposed on the lower surface of the dielectric layer 14. The protective layer 15, which faces the rear panel 2, serves to prevent ions and electrons from contacting the dielectric layer 14 and the discharge-maintaining electrodes 12*a*, 12*b* for effectively preventing the dielectric layer 14 and the discharge-maintaining electrodes 12*a*, 12*b* from being unduly worn.

The protective layer 15 also has a function to emit secondary electrons necessary to generate a plasma discharge, and an important function to lower the discharge starting voltage. The protective layer 15 may be made of magnesium oxide (MgO), magnesium fluoride ($MgF_2$), or calcium fluoride ($CaF_2$), for example. Of these material, magnesium oxide is the most preferable material because it is chemically stable and has a low sputtering ratio, a high light transmission at the wavelength of light emitted by the phosphor, and a low discharge starting voltage.

The protective layer 15 may be of a laminated-film structure made of at least two materials selected from the group of the above materials.

The rear panel 2 has a rear glass substrate 21 which is made of high-strain-point glass or soda glass, for example, and which is transparent and insulative, and a plurality of address electrodes 22 for writing image data, disposed on the upper surface of the rear glass substrate 21 and extending perpendicularly to the pairs of discharge-maintaining electrodes 12*a*, 12*b* of the front panel 1.

The rear glass substrate 21 is made of a material which may not necessarily be the same as the material of the front glass substrate 11. However, the material of the rear glass substrate 21 should desirably have the same coefficient of thermal expansion as the material of the front glass substrate 11.

The address electrodes 22 are made of a transparent electrically conductive material which is the same as the transparent electrically conductive material of the discharge-maintaining electrodes 12*a*, 12*b*. The width of each of the address electrodes 22 is in the range from about 50 to 100 μm, for example.

The rear panel 2 also includes a dielectric layer 23 disposed on the upper surface of the rear glass substrate 21 in covering relation to the address electrodes 22. The dielectric layer 23 is formed by depositing a glass paste layer having a low melting point on the entire upper surface of the rear glass substrate 21 according to a screen printing process and then baking the deposited glass paste layer.

A plurality of partitions 24 extending parallel to the address electrodes 22 are disposed on the dielectric layer 23 at respective positions substantially intermediate between adjacent ones of the address electrodes 22. Each of the partitions 24 has a width of about 50 μm or less, for example, and a height in the range from about 90 to 150 μm, for example. The pitch or interval between adjacent ones of the partitions 24 is in the range from about 100 to 400 μm, for example.

A plurality of phosphor layers 25 are disposed in regions between adjacent ones of the partitions 24 and extend up to upper ends of the partitions 24. The phosphor layers 25 include a plurality of sets of adjacent phosphor layers 25R, 25G, 25B coated with materials for emitting red (R) light, green (G) light, and blue (B) light, respectively. Each set of phosphor layers 25R, 25G, 25B provides pixels.

Between the front and rear panels 1, 2 which confront each other and which are joined to each other along peripheral edges by frit glass, there are provided striped discharge spaces 4 each surrounded by two adjacent partitions 24, the protective layer 15 on the lower surface of the front glass substrate 11, and the phosphor layer 25 between the partitions 24 above the rear glass substrate 21.

The discharge spaces 4 are filled with a rare gas such as Ne, Xe, He, Ar, Ne or the like or a mixture thereof. The gas in the discharge spaces 4 has a total pressure which is not limited to any value, but should preferably be in the range from about 6 to 80 kPa.

When an AC voltage having a frequency ranging from several tens to several hundreds kHz is applied through the bus electrodes 13*a*, 13*b* between the discharge-maintaining electrodes 12*a*, 12*b*, a plasma discharge occurs in the rare gas, exciting rare gas molecules. When the excited rare gas molecules return to the ground state, they generate an ultraviolet radiation which excites the phosphor layers 25 to emit light.

The phosphor layers 25R, 25G, 25B emit R, G, B lights, respectively. The address electrodes 22 are selectively energized to select desired pixels to emit light in desired colors for thereby displaying a color image on the plasma display panel.

When the AC voltage applied through the bus electrodes 13*a*, 13*b* between the discharge-maintaining electrodes 12*a*, 12*b*, as shown in FIG. 2, a displacement current flows to charge an electrostatic capacitance 40*a* having a dielectric body provided by the cluster of fine particles of silica between the discharge-maintaining electrodes 12*a*, 12*b* and an electrostatic capacitance 41 having a dielectric body provided by the dielectric layer 14 between the discharge-maintaining electrodes 12*a*, 12*b*.

According to the present embodiment, the dielectric layer 30 in the form of a cluster of fine particles of silica is disposed between the front glass substrate 11 and the discharge-maintaining electrodes 12*a*, 12*b*. The dielectric layer 30 has pores between adjacent fines particles 30*a* of silica, and has a relative permittivity smaller than the relative permittivity, e.g., 4, of silica ($SiO_2$). Therefore, the electrostatic capacitance 40*a* between the discharge-maintaining electrodes 12*a*, 12*b* is reduced to the reduce power consumption, i.e., reactive power, of the AC-driven PDP.

Figure 4:
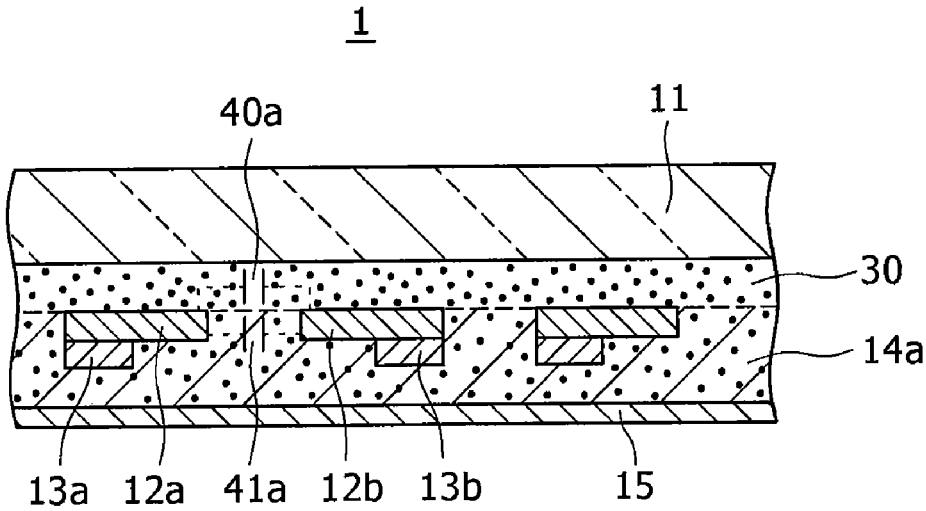
FIG. 4 is a fragmentary cross-sectional view of a front panel according to another embodiment.

FIG. 4 shows in fragmentary cross section a front panel according to another embodiment. Those parts of the front panel shown in FIG. 4 which are identical to those shown in FIGS. 1 and 2 are denoted by identical reference characters, and will not be described in detail below.

As shown in FIG. 4, the dielectric layer covering the pairs of discharge-maintaining electrodes 12*a*, 12*b* includes a dielectric layer 14*a* in the form of a cluster of fine particles of silica as with the dielectric layer 30. Other details of the front panel shown in FIG. 4 are identical to those shown in FIGS. 1 and 2.

The dielectric layer 14*a* in the form of a cluster of fine particles of silica may be formed in the same manner as the dielectric layer 30.

The AC-driven PDP including the front panel 1 shown in FIG. 4 offers the same advantages as the AC-driven PDP shown in FIG. 1. An electrostatic capacitance 41*a* having a dielectric body provided by the dielectric layer 14*a* between the discharge-maintaining electrodes 12*a*, 12*b* is reduced to reduce the power consumption, i.e., reactive power, of the AC-driven PDP.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A plasma display panel comprising:

a front panel comprising a front glass substrate, a plurality of pairs of discharge-maintaining electrodes disposed over said front glass substrate, and a first dielectric layer disposed in covering relation to said pairs of discharge-maintaining electrodes; and a rear panel disposed in confronting relation to said front panel with discharge spaces interposed therebetween;

said front panel including a second dielectric layer disposed between said front glass substrate and said pairs of discharge-maintaining electrodes, said second dielectric layer comprising a cluster of fine particles of silica wherein said fine particles of silica include fine particles of silica having different diameters each up to 100 nm.

2. The plasma display panel according to claim 1, wherein said second dielectric layer has a thickness ranging from 1 to 100 μm.

3. The plasma display panel according to claim 1, wherein said second dielectric layer has a multi-layer structure comprising a plurality of layers including said fine particles of silica.

4. A plasma display panel comprising:

a front panel comprising a front glass substrate, a plurality of pairs of discharge-maintaining electrodes disposed over said front glass substrate, and a dielectric layer disposed between said front glass substrate and said pairs of discharge-maintaining electrodes and in covering relation to said pairs of discharge-maintaining electrodes, said dielectric layer comprising a cluster of fine particles of silica; and a rear panel disposed in confronting relation to said front panel with discharge spaces interposed therebetween wherein said fine particles of silica include fine particles of silica having different diameters each up to 100 nm.

5. The plasma display panel according to claim 4, wherein said fine particles of silica include fine particles of silica having different diameters each up to 100 nm.

* * * * *